US007752979B2

(12) United States Patent
Early

(10) Patent No.: US 7,752,979 B2
(45) Date of Patent: Jul. 13, 2010

(54) HOPPER CAR GATE WITH ENLARGED DISCHARGE AND INCREASED CAPACITY

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 136 days.

(21) Appl. No.: 11/906,926

(22) Filed: Oct. 4, 2007

(65) Prior Publication Data

US 2009/0090269 A1 Apr. 9, 2009

(51) Int. Cl.
*B61D 7/20* (2006.01)

(52) U.S. Cl. ..... 105/282.1; 105/247; 105/248; 105/282.3; 105/288

(58) Field of Classification Search ..... 105/247–249, 105/282.1, 282.3, 288, 821
See application file for complete search history.

(56) References Cited

U.S. PATENT DOCUMENTS 272,550 A * 2/1883 Hoit ..... 105/248
740,819 A * 10/1903 Davis ..... 105/248
820,240 A * 5/1906 Mulock ..... 105/243
2,072,292 A * 3/1937 Argyle ..... 105/282.1
6,637,346 B2 * 10/2003 Gaydos ..... 105/247

* cited by examiner

*Primary Examiner*—S. Joseph Morano
*Assistant Examiner*—Zachary Kuhfuss
(74) *Attorney, Agent, or Firm*—Stinson Morrison Hecker LLP

(57) ABSTRACT

A hopper car having an increased volume. The car has side walls, end walls, a bottom, and first and second sloping surfaces. The bottom lies at least partially in a horizontal plane and includes a plurality of spaced apart openings. The side walls, end walls, and horizontal plane define a volume X. The first and second sloping surfaces are located between adjacent openings and joined to the bottom adjacent the openings. The sloping surfaces extend upwardly from the bottom to present an inverted V enclosing a volume Y. The volume Y is no more than approximately 1 to 5% of the volume X.

24 Claims, 3 Drawing Sheets

HOPPER CAR GATE WITH ENLARGED DISCHARGE AND INCREASED CAPACITY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is related in general to a hopper car for carrying bulk materials and more particularly to a hopper car having an increased volume for carrying the bulk materials.

2. Description of Related Art

Hopper cars are commonly used to transport and sometimes store bulk materials. Hopper cars include one or more hoppers which allow the bulk materials to be discharged from the car bottom. Each hopper has a discharge opening at its bottom in order to discharge the cargo. The cargo may be discharged into a large pit, or into chutes corresponding with the hopper openings. A variety of door and gate assemblies in conjunction with various opening mechanisms are used to open and close hopper car discharge openings.

There are maximum exterior dimensions to which hopper cars must conform. For example, the Association of American Railroads (AAR) establishes maximum clearance dimensions for all railcars including hopper cars. Also, the Federal Highway Administration and state agencies establish maximum width and height requirements for freight trucks. To effectively discharge all bulk materials residing in a hopper car, the lower portion of the hopper walls are angled. The desired angle depends on what type of material the hopper car is transporting. Moreover, discharge openings on a hopper car are generally sized to fit traditional gate sizes. Increasing the number of discharge openings on a given hopper car increases car construction expenses. It is therefore desirable to maximize volumetric capacity of a hopper car within the specified dimensional requirements while minimizing car construction expense.

BRIEF SUMMARY OF THE INVENTION

The present invention is directed towards a hopper car having an increased volume for transporting bulk solids. The hopper car has opposed generally upright side walls, opposed generally upright end walls joined to each of the side walls, a bottom joined with each of the side walls and each of the end walls, and first and second sloping surfaces which extend toward a pair of openings.

The bottom of the car has a plurality of spaced apart openings and lies at least partially within a horizontal plane. The side walls, end walls, and horizontal plane define a theoretical volume X. The first and second sloping surfaces are joined to the bottom adjacent to the openings, and extend upwardly from the bottom to an apex. The first and second sloping surfaces present an inverted V enclosing a volume Y. The volume Y is no more than approximately 1 to 5% of the volume X.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 2:
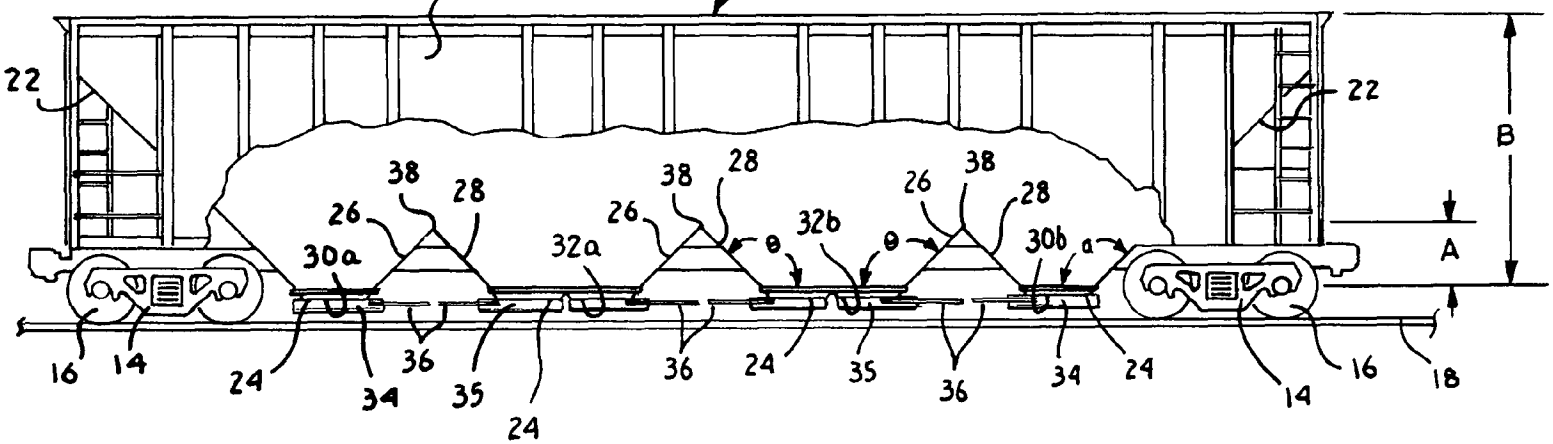
FIG. 2 is a side elevational view, with portions broken away, of one embodiment of a hopper car having increased volume showing lower apices than the corresponding structure in the hopper car of FIG. 1.

A railroad hopper car 10 for transporting bulk solids is depicted in FIG. 2. The hopper car has a container 12 and truck assemblies 14. A longitudinal dimension of the car extends between truck assemblies 14. Two truck assemblies 14 are connected to opposite ends of the car. Truck assemblies 14 include wheels 16 that roll on rail track 18.

Container 12 has vertical side walls 20, sloped end walls 22, and a horizontal discontinuous bottom 24. Side walls 20 are connected to end walls 22. Bottom 24 lies in a horizontal plane and is connected to side walls 20, end walls 22, and first and second sloping surfaces 26, 28. A theoretical volume X is defined by the aforementioned bottom, sides, and ends.

Figure 3:
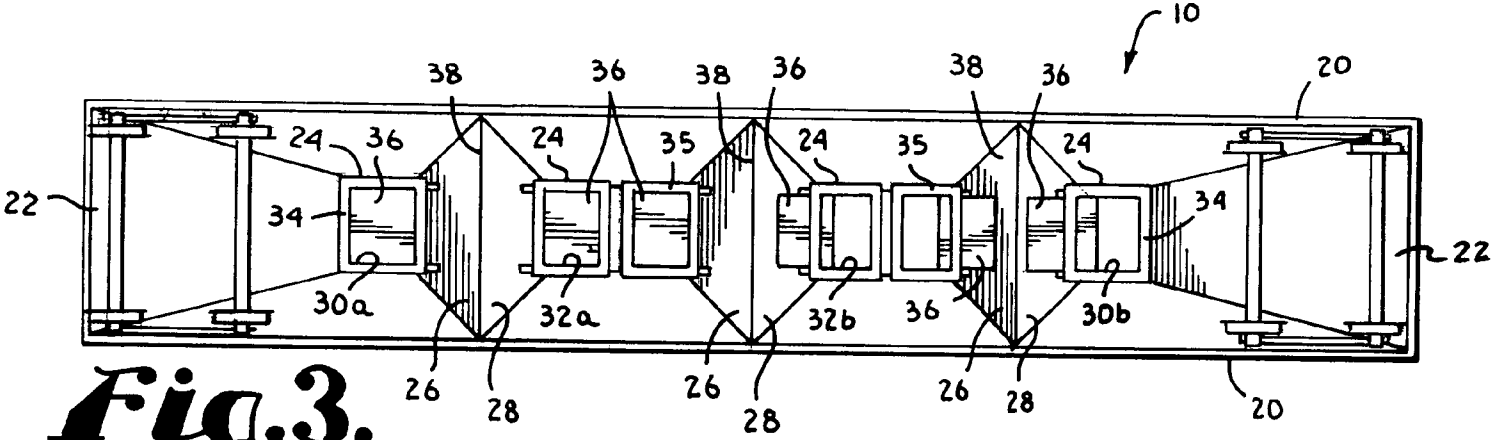
FIG. 3 is a bottom plan view of the hopper car of FIG. 2.

As shown in FIGS. 2 and 3, bottom 24 has two end openings 30*a*, 30*b* and two intermediate openings 32*a*, 32*b*. Intermediate openings 32*a*, 32*b* have approximately twice the length of end openings 30*a*, 30*b*. Gate frame 34 surrounds each of openings 30*a-b*. Each gate frame 34 mounts a gate 36. Gate frame 35 surrounds each of intermediate openings 32*a*, 32*b*. Each gate frame 35 mounts two gates 36 in side-by-side relationship. FIG. 2 depicts all of gates 36 in an open position. As depicted in FIG. 3, end opening 30*a* and intermediate opening 32*a* have gates 36 in a closed position, while end opening 30*b* and intermediate opening 32*b* have gates 36 in an open position. Gates 36 move from their closed positions to their open positions in a direction parallel to the longitudinal dimension of car 10. Bulk solids are retained within container 12 when gates 36 are in their closed positions. Bulk solids exit container 12 through openings 30*a-b*, 32*a-b* when gates 36 are in their open positions.

First and second sloping surfaces 26, 28 are located between adjacent openings 30*a-b*, 32*a-b*. First and second sloping surfaces 26, 28 are connected to bottom 24 and extend upwardly from bottom 24 to present an inverted V. First surface 26 joins second surface 28 at an apex 38 halfway between adjacent openings. The vertical distance between bottom 24 and apex 38 is represented in FIG. 2 by the letter A. The vertical height of side wall 20 is represented in FIG. 2 by the letter B. The distance A is approximately 30% of distance B. A volume is defined by the inverted V, bottom 24, and side walls 20. This volume, multiplied by the number of inverted V's represents a total void volume Y which is approximately 4% of the volume X. Y is designated "void volume" because it represents that volume of the car which is lost for cargo-carrying purposes. In an alternative embodiment, car 10 may have two openings and one inverted V presented between the openings. For this construction, it is to be understood that the volume enclosed by the single inverted V represents the volume Y.

The angle formed between each end wall 22 and bottom 24 is represented in FIG. 2 by the symbol α. The angle formed between each of the first and second sloping surfaces 26, 28 and bottom 24 is represented in FIG. 2 by the symbol θ. Each of the angles α and θ are approximately 135 degrees.

Figure 1:
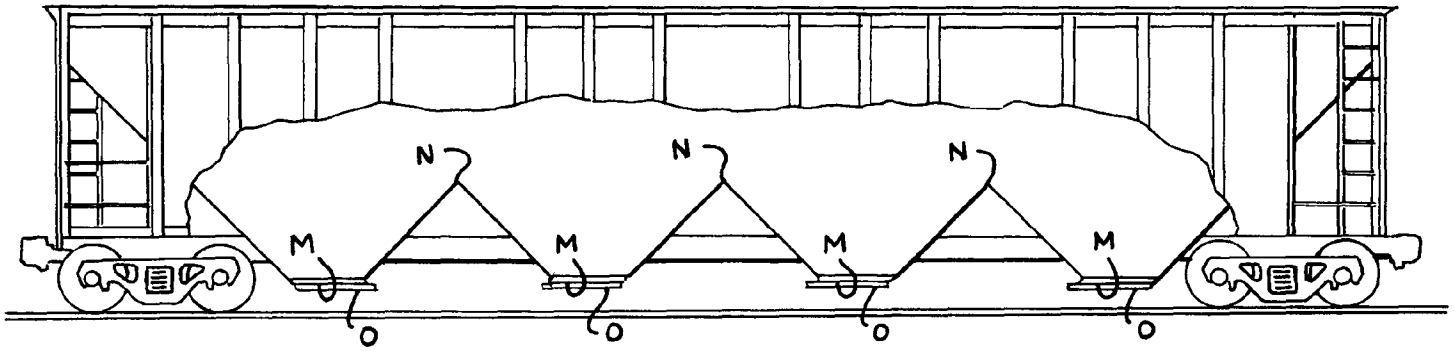
PRIOR ART Fig. 1.
FIG. 1 is a side elevational view, with portions broken away, of a conventional railroad hopper car.

A conventional hopper car construction is depicted in FIG. 1 and contains the same basic structural elements as described above for the present invention. The one notable difference, however, is that the inverted V-shaped structures N which are spaced between the openings M in the bottom of the car extend upwardly a greater distance than is the case with the aforedescribed invention so that the size of openings M is reduced and accordingly the size of gates O which close the openings is also reduced. The disadvantage of this construction is that the total void volume presented by the inverted V's, the car bottom, and the car sidewalls, is up to 13% of the theoretical car volume. It has heretofore been thought that reducing the void volume was not feasible because it would result in much larger openings requiring larger gates to close the openings. As can be seen from viewing FIGS. 2 and 3, the size of intermediate openings 32*a*, 32*b* of the hopper car 10 according to the present invention is at least 50% greater than end openings 30*a*, 30*b*, these latter openings being typical of the size of all the openings M in a conventional hopper car. The reduction in void volume gives the car of FIG. 2 an approximately 6% increase in cargo carrying volume over the conventional car depicted in FIG. 1. This reduction in void volume is accomplished while maintaining the angle θ substantially the same for a car according to the present invention as a car having a conventional construction.

Figure 4:
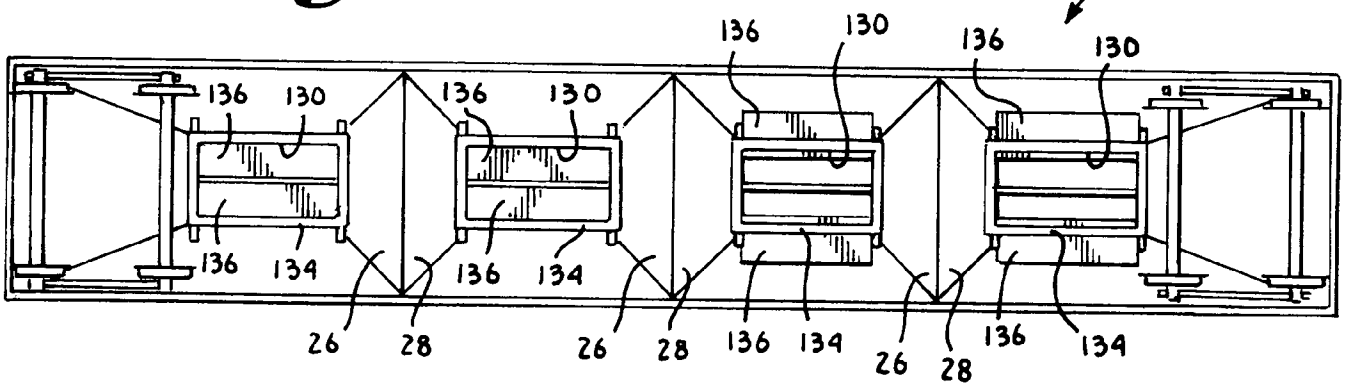
FIG. 4 is a bottom plan view of an alternative embodiment of the hopper car according to the present invention, showing gates opening in a direction transverse to the longitudinal dimension of the car.

An alternative embodiment of a hopper car according to the present invention is shown in FIG. 4 and designated generally by the number 110. The car 110 is substantially identical to car 10 described above except that it presents four large rectangular openings 130 which are surrounded by gate frames 134, and are spaced equidistant along the length of the car. Each gate frame 134 mounts a pair of rectangular gates 136 which are movable in a direction transverse to the longitudinal dimension of the car as illustrated for the two right hand openings shown in FIG. 4. It will be appreciated that openings 130 are approximately 100% larger than a conventional car opening. This is possible as a result of the reduced size of the inverted V structures presented by sloping surfaces 26 and 28.

Figure 5:
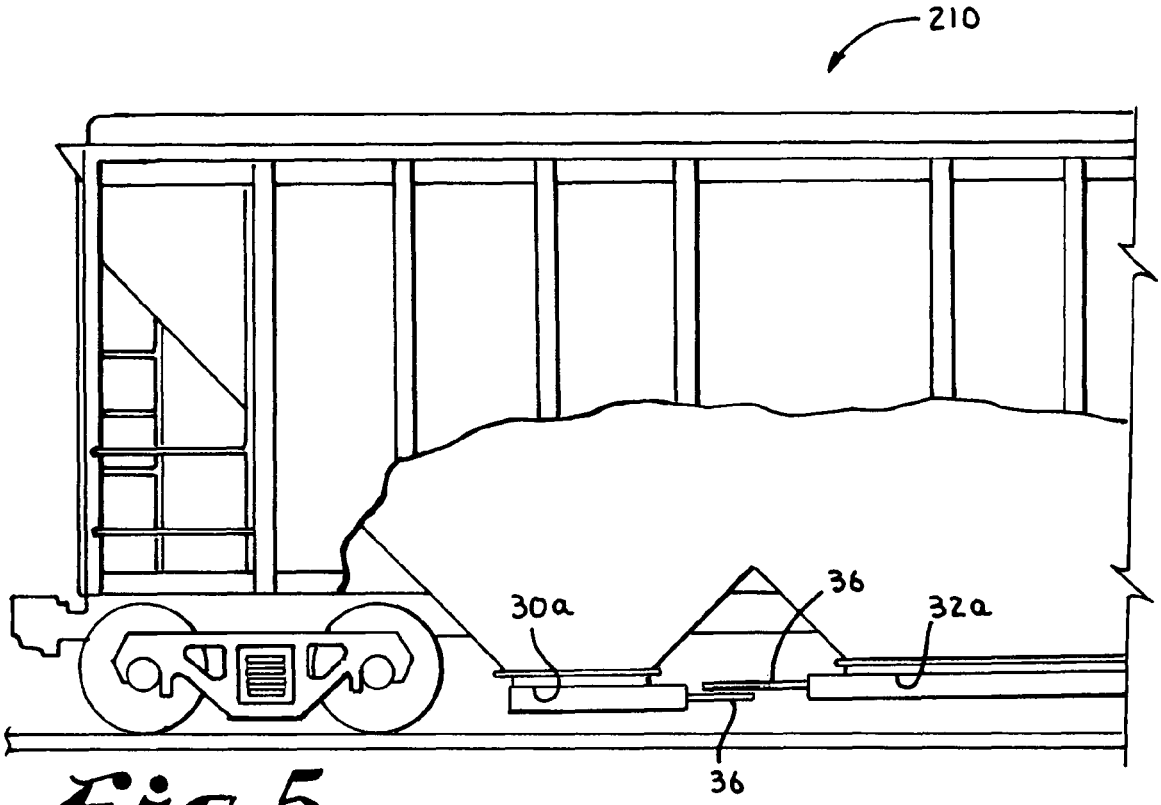
FIG. 5 is a fragmentary side elevational view, with portions broken away, of another alternative embodiment of the hopper car according to the present invention, showing vertically spaced openings.

Another alternative embodiment of the invention is shown in FIG. 5 wherein a hopper car is designated generally by the numeral 210. Car 210 is identical in all respects to the hopper car 10 described above except for the fact that openings 30*a* and 32*a* are vertically staggered by approximately 3 inches so that horizontal movement of gates 36 can be accommodated with one gate 36 moving on top of a second gate 36 as shown in FIG. 5.

In operation, an operator of the embodiment depicted in FIGS. 2 and 3 moves all of gates 36 to a closed position and fills container 12 with bulk solids. The hopper car 10 is then moved to a desired location above a pit (not shown) corresponding with openings 30*a-b*, 32*a-b* on the bottom of the car. An operator utilizes any of the gate opening devices known in the art to move the gates 36 from their closed positions to their open positions. Gates 36 move in a direction parallel to the longitudinal dimension of car 10. When gates 36 are open, the bulk solids are gravity fed into the pit. The embodiment depicted in FIG. 4 operates in the same fashion except that gates 136 move from a closed position to an open position in a direction transverse to the longitudinal dimension of car 110. The embodiment depicted in FIG. 5 operates in the same fashion as the previous embodiments except that when gates 36 are opened, they move in vertically spaced relationship.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense. For example, the present invention may include more or less than the four openings depicted in FIGS. 2-4. While as depicted intermediate openings 32*a-b* are approximately twice the size of end openings 30*a-b*, in one preferred embodiment these openings are between 50 to 67% greater than the size of all of the openings M on a conventional hopper car. While all gates shown on a single car move in the same direction, there may be some gates on a car that move in a direction parallel to the longitudinal dimension of the car, and other gates on the same car that move in a direction transverse to the longitudinal dimension of the car. Likewise, it is within the scope of the present invention to have gates that follow an arcuate path. It is also within the scope of the invention to have a gate frame mounting more than two gates.

Accordingly, while FIG. 2 depicts volume Y as approximately 4% of volume X, it is within the scope of the invention for volume Y to be between 1 to 5% of volume X. In conventional hopper cars, like that depicted in FIG. 1, the total void volume is about 8 to 13% of the theoretical car volume. Further, while the hopper car of FIG. 2 has an approximately 6% increase in cargo carrying volume over a conventional hopper car, like that depicted in FIG. 1, in alternative embodiments the present invention has between a 3 to 12% increase in cargo carrying volume over a conventional hopper car.

Even though as depicted in FIG. 2, distance A is approximately 30% of distance B, it is within the scope of the invention for distance A to be between 30 to 50% of distance B. While as depicted in FIG. 2 angles α and θ are approximately 135 degrees, it is within the scope of the invention for angles α and θ to be between 125 and 145 degrees. Accordingly, angles α and θ do not have to be equal. The present invention may also have a bottom with a non-planar configuration, in which case theoretical volume X is calculated using the actual shape of the bottom as extended between the openings instead of using a horizontal plane.

While as depicted in FIG. 5, the distance between vertically spaced openings 30*a*, 32*a* is 3 inches, it is within the scope of the invention for the distance to be between 1 and 6 inches. While the cars 10, 110 depicted in FIGS. 2-4 do not have a top cover, it is within the scope of the invention to provide a cover. Finally, while the invention is described here as a railroad hopper car, it is within the scope of the invention to have a hopper car that is not a railcar. For instance, the hopper car could be associated with an over the road vehicle.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired is to be secured by Letters Patent is as follows:

1. A hopper car for transporting bulk solids, said car comprising:

opposed generally upright side walls;

opposed generally upright end walls joined to each of said side walls;

a bottom joined with each of said side walls and each of said end walls, said bottom having a plurality of spaced apart openings, wherein at least one of said openings has a length extending in a direction parallel to a longitudinal dimension of said car and a width extending in a direction transverse to said longitudinal dimension, and wherein said length of said opening is about twice said width, wherein each of said openings is approximately equidistant from each of said side walls and there is no more than one of said openings positioned in any vertical plane that is transverse to said longitudinal dimension, and wherein at least two of said plurality of openings are vertically spaced relative to each other; and first and second sloping surfaces between adjacent openings, said surfaces being joined to said bottom adjacent said openings and extending upwardly from said bottom to an apex to present an inverted V.

2. The hopper car of claim 1, wherein said side walls comprise two parallel opposed generally upright walls.

3. The hopper car of claim 1, wherein each of said end walls is inclined relative to said bottom forming an angle $\alpha$.

4. The hopper car of claim 3, wherein said first and second sloping surfaces are inclined relative to said bottom forming an angle $\theta$, and wherein said angle $\alpha$ equals said angle $\theta$.

5. The hopper car of claim 4, wherein said angle $\alpha$ is between 125 and 145 degrees.

6. The hopper car of claim 5, wherein said angle $\alpha$ is approximately 135 degrees.

7. The hopper car of claim 1, wherein said plurality of openings comprises at least three openings.

8. The hopper car of claim 1, further comprising a plurality of gates, each of said gates moveable between a closed position which blocks one of said openings and an open position which allows the bulk solids to exit the car through the opening.

9. The hopper car of claim 8, wherein at least one of said gates moves from said closed position to said open position in a direction transverse to a longitudinal dimension of said car.

10. The hopper car of claim 8, wherein at least one of said gates moves from said closed position to said open position in a direction parallel to a longitudinal dimension of said car.

11. The hopper car of claim 1, wherein the vertical distance between said at least two spaced openings is between 1 and 6 inches.

12. The hopper car of claim 11, wherein the vertical distance between said at least two spaced openings is approximately 3 inches.

13. The hopper car of claim 1, wherein said hopper car is a railroad hopper car for transporting bulk solids.

14. The hopper car of claim 1, wherein the vertical distance between said bottom and said apex is A, the height of said side wall is B, and the distance A is no more than approximately 30 to 50% of the height B.

15. A method of constructing a hopper car for transporting bulk solids, said method comprising:

providing at least two opposed generally upright side walls;

providing at least two opposed generally upright end walls joined to each of said side walls;

providing a bottom joined with each of said side walls and each of said end walls, said bottom having a plurality of spaced apart openings, wherein at least one of said openings has a length extending in a direction parallel to a longitudinal dimension of said car and a width extending in a direction transverse to said longitudinal dimension, and wherein said length of said opening is about twice said width, wherein each of said openings is approximately equidistant from each of said side walls and there is no more than one of said openings positioned in any vertical plane that is transverse to said longitudinal dimension, and wherein at least two of said plurality of openings are vertically spaced relative to each other; and providing first and second sloping surfaces between adjacent openings, said surfaces being joined to said bottom adjacent said openings and extending upwardly from said bottom to an apex to present an inverted V.

16. The method of claim 15, wherein each of said end walls is inclined relative to said bottom forming an angle $\alpha$, wherein said first and second sloping surfaces are inclined relative to said bottom forming an angle $\theta$, and wherein said angle $\alpha$and said angle $\theta$ are approximately 135 degrees.

17. The method of claim 15, wherein at least one of said gates moves from said closed position to said open position in a direction transverse to a longitudinal dimension of said car.

18. A hopper car for transporting bulk solids, said car comprising:

opposed generally upright side walls;

opposed generally upright end walls joined to each of said side walls;

a bottom joined with each of said side walls and each of said end walls, said bottom having a plurality of spaced apart openings, wherein at least two of said plurality of openings are vertically spaced relative to each other to accommodate horizontal movement of gates that are mounted to said bottom adjacent said vertically spaced openings such that one of said gates moves horizontally on top of another of said gates; and first and second sloping surfaces between adjacent openings, said surfaces being joined to said bottom adjacent said openings and extending upwardly from said bottom to an apex to present an inverted V.

19. The hopper car of claim 18, wherein at least one of said openings has a length extending in a direction parallel to a longitudinal dimension of said car and a width extending in a direction transverse to said longitudinal dimension, and wherein said length of said opening is about twice said width.

20. The hopper car of claim 18, wherein each of said openings is approximately equidistant from each of said side walls and there is no more than one of said openings positioned in any vertical plane that is transverse to a longitudinal dimension of said car.

21. The hopper car of claim 18, wherein the vertical distance between said at least two spaced openings is between 1 and 6 inches.

22. The hopper car of claim 21, wherein the vertical distance between said at least two spaced openings is approximately 3 inches.

23. The hopper car of claim 1, wherein said openings comprise at least two end openings and one intermediate opening that is positioned between said end openings, wherein said intermediate opening has a size that is at least 50% greater than at least one of said end openings.

24. The hopper car of claim 23, wherein said intermediate opening has a size that is between 50 to 67% greater than at least one of said end openings.

* * * * *